US005313133A

United States Patent [19]

Park

[11] Patent Number: 5,313,133

[45] Date of Patent: May 17, 1994

[54] ELECTRON GUN FOR CATHODE RAY TUBE WITH IMPROVED CATHODE STRUCTURE

[75] Inventor: Gong S. Park, Gumi-City, Rep. of Korea

[73] Assignee: Gold Star Co., Ltd., Seoul, Rep. of Korea

[21] Appl. No.: 853,969

[22] Filed: Mar. 20, 1992

[30] Foreign Application Priority Data

Mar. 22, 1991 [KR] Rep. of Korea ..... 91-4561

[51] Int. Cl.[5] ..... H01J 29/04; H01J 29/48

[52] U.S. Cl. ..... 313/270; 313/446

[58] Field of Search ..... 313/270, 337, 340, 446

[56] References Cited

U.S. PATENT DOCUMENTS 4,000,435 12/1976 Jariwala ..... 313/337 X 4,912,362 3/1990 Barthelemy et al. ..... 313/270

5,030,879 7/1991 Derks ..... 313/337 X

FOREIGN PATENT DOCUMENTS 989928 5/1976 Canada ..... 313/446

*Primary Examiner*—Sandra L. O'Shea

*Attorney, Agent, or Firm*—Poms, Smith, Lande & Rose

[57] ABSTRACT

An improved cathode structure in an electron gun for a cathode ray tube comprises a sleeve having a cylindrical shape, a heater disposed in the interior of the sleeve, a cap disposed at the upper portion of the sleeve, and an electron-emitting material layer coated on the outer top surface of the cap. A gap having a dimension that is 13.5% to 15.5% of the inner diameter of the sleeve, is defined between the sleeve and the heater, thereby improving an overshoot in emission of electrons at an initial operation state of heater.

3 Claims, 2 Drawing Sheets

ELECTRON GUN FOR CATHODE RAY TUBE WITH IMPROVED CATHODE STRUCTURE

BACKGROUND OF THE INVENTION

1. Field of the Invention

The present invention relates to an electron gun for a cathode ray tube, and more particularly to an improved cathode structure in the electron gun which is capable of optimizing a space or gap between a sleeve and a heater received in the sleeve in order to improve an overshoot in emission of electrons.

2. Description of the Prior Art

Generally, such an electron gun is disposed in a neck formed at the rear of a cathode ray tube and provided with a cathode for emitting electron beams, so as to scan electron beams on a phosphor screen formed at the front of the cathode ray tube. This cathode should have such a structure that defines properly a space or gap between a heater and a sleeve, in order to maintain an overshoot in emission of electrons within an allowable range.

In conventional cathode structures, however, the gap defined between the heater and the sleeve is small, thereby causing the occurrence of an overshoot in emission of electrons exceeding the allowable range. This disadvantage will now be described, in conjunction with one example of conventional cathode structure illustrated in FIG. 1.

As shown in FIG. 1, the cathode structure comprises a sleeve 3 having a cylindrical shape and a heater 5 disposed in the interior of sleeve 3. The heater 5 includes a heating coil wire wound in the form of coil spring with a proper outer diameter D1 and a proper height L. The sleeve 3 is provided at the upper portion thereof with a cap 2 which is coated at its outer top surface with a layer 1 of an electron-emitting material such as carbonated oxide. The sleeve 3 is also provided at the lower portion thereof with a holder 4 through which a pair of heater taps 5*a* and 5*b* extends upwardly to be connected to the heater 5. The heater 5 has an outer diameter that is about 79% to 85% of the inner diameter D2 of the sleeve 3.

With this construction, as drive voltage of about 6.3 V is applied to heater taps 5*a* and 5*b*, the heater 5 generates heat of up to about 800° C. by the drive voltage and applies the generated heat to the sleeve 3 and the cap 2. The cap 2 then transfers the heat from the heater 5 to the electron-emitting material layer 1. By the heat transmitted from the heater 5 via the cap 2, the electron-emitting material layer 1 emits thermal electrons. In the initial operation state, the electron-emitting material layer 1 emits an amount of electrons that is about 140% to 127% of the amount of electrons in the normal operation state. And a long time is taken until the amount of emitted electrons is maximized after the application of drive voltage to the heater taps 5*a* and 5*b*. This is because the amount of heat transferred from the heater 5 to the cap 4 includes the amount of heat by heat conduction. In this case, the generation of heat by heat conduction is caused by a reduction in the gap defined between the inner surface of the sleeve 3 and the outer surface of the heater 5. The reason for this reduced gap is that the heater 5 and the sleeve 3 expand abruptly, due to sudden heating of the heater 5. The gap has a size in the normal state when the heater 5 generates heat of a normal temperature.

As a result, the conventional cathode structure has a disadvantage that the size of gap between the heater 5 and the sleeve 3 is excessively reduced due to expansion of the sleeve 3 and the heater 5, in the initial operation state, that is, when the heater 5 suddenly generates heat. Due to this excessive reduction in the size of gap, the conventional cathode structure has a problem in that the amount of electrons emitted from the electron-emitting material layer 1 in the initial operation state cannot be maintained within an allowable range, that is, about 100% to 120% of the amount of electrons emitted in the normal state.

SUMMARY OF THE INVENTION

Accordingly, it is an object of the present invention to provide an electron gun for a cathode ray tube with an improved cathode structure which can improve an overshoot in emission of electrons from an electron-emitting material layer in the initial operation state.

In accordance with the present invention, this object is accomplished by providing a cathode structure in an electron gun for a cathode ray tube comprising; a sleeve having a cylindrical shape; a cap disposed at the upper portion of the sleeve; an electron-emitting material layer coated on the outer top surface of the cap to emit thermal electrons; and a heater disposed in the interior of the sleeve such that a predetermined dimension of gap is defined between the inner surface of the sleeve and the outer surface of the heater, to heat the electron-emitting material layer, said gap having a dimension that is substantially 13.5% to 15.5% of the inner diameter of the sleeve, thereby improving an overshoot in emission of electrons in the initial operation state of the heater.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 3:
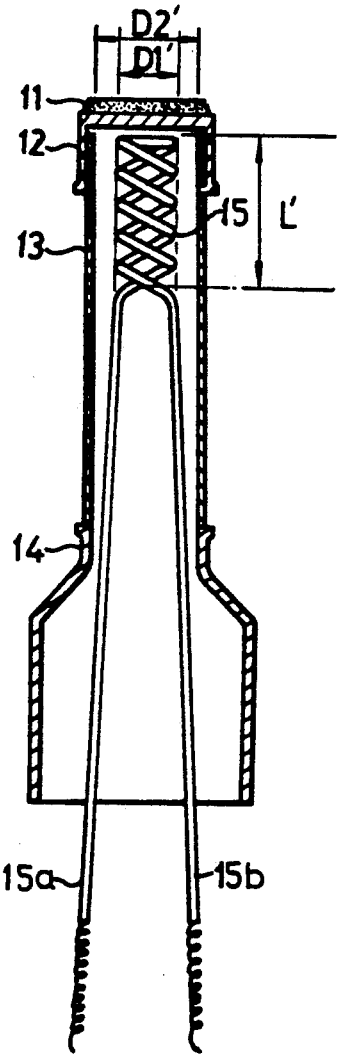
FIG. 3 is a sectional view of an improved cathode structure in an electron gun according to the present invention.
Figure 2:
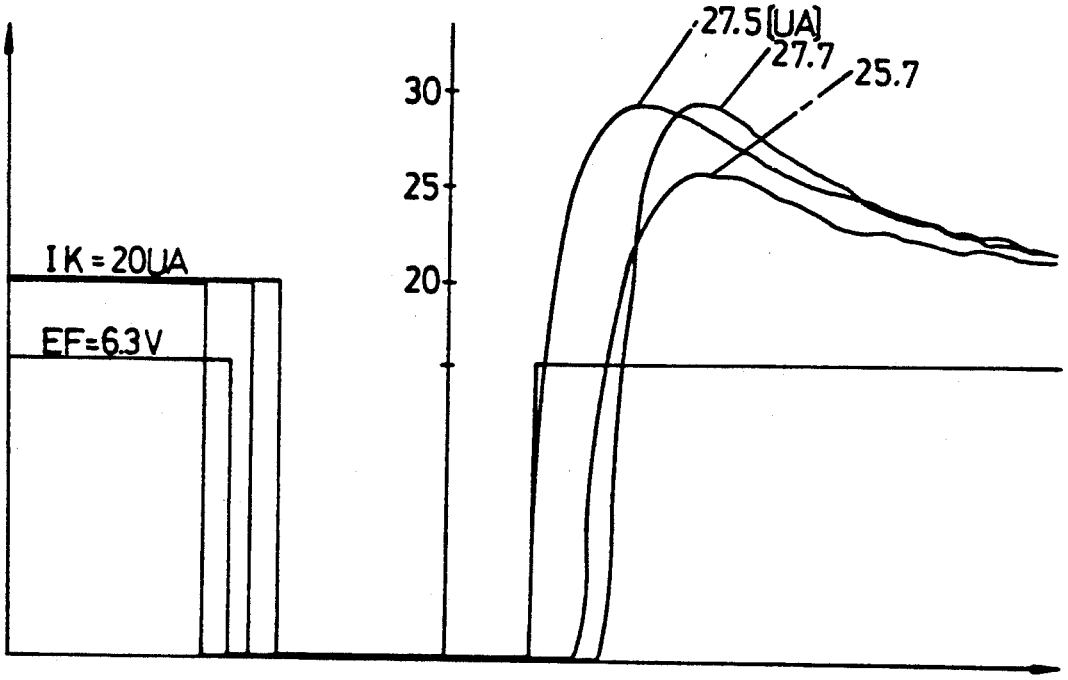
FIG.2 PRIOR ART
FIG. 2 illustrates an electron-emission characteristic of the conventional cathode structure in FIG. 1.

Referring to FIG. 3, there is illustrated a cathode structure in accordance with the present invention. The cathode structure comprises a sleeve 13 having a cylindrical shape and a cap 12 disposed at the upper portion of the sleeve 13. The cap 12 is coated at its outer top surface with a layer 11 of an electron-emitting material such as carbonated oxide.

A heater 15 is disposed in the interior of the sleeve 13 such that a space or gap is defined to have a predetermined distance or size between the heater 15 and the inner surface of the sleeve 13. The size of gap corresponds to about 13.5% to 15.5% of the inner diameter D2' of the sleeve 13, based on the following formula:

$$\frac{D2' - D1'}{2*D2'} * 100\ (\%)$$

The heater 15 comprises a heating coil wire wound in the form of a coil spring and having a proper outer diameter D1' and a proper height L'.

At the lower portion of the sleeve 13, a holder 14 is disposed which has at the lower end thereof a pair of heater taps 15*a* and 15*b*. Heater taps 15*a* and 15*b* extend upwardly through the holder 14 and are connected to the heater 15. A drive voltage from an external power supply not shown is applied to the heater taps 15*a* and 15*b*, so as to drive the heater 15.

Figure 1:
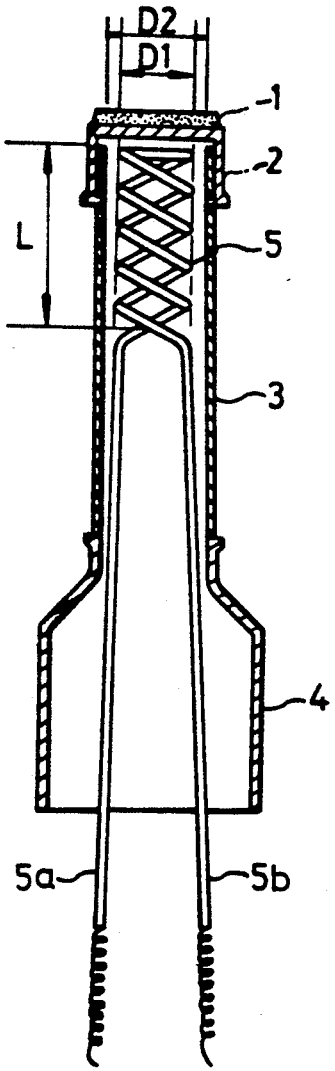
FIG.1 PRIOR ART
FIG. 1 is a sectional view of a conventional cathode structure in an electron gun for a cathode ray tube.

This cathode structure of the present invention illustrated in FIG. 3 is substantially similar to the conventional cathode structure illustrated in FIG. 1, in terms of shape and construction. However, the ratio of the outer diameter D1' of the heater 15 to the inner diameter D2' of the sleeve 13 in the cathode structure of the present invention is smaller than that of the outer diameter D1 of the heater 5 to the inner diameter D2 of the sleeve 3 in the conventional cathode structure. That is, the diameter ratio according to the present invention corresponds to about 69% to 73%, while the diameter ratio in the conventional cathode structure corresponds to about 79% to 85%. Accordingly, the gap defined between the heater 15 and the sleeve 13 in the cathode structure of FIG. 3 has a dimension larger than that in the conventional cathode structure of FIG. 1. In other words, the size of gap in case of FIG. 3 corresponds to about 13.5% to 15.5% of the inner diameter D2' of the sleeve 13, whereas the size of gap in case of FIG. 1 corresponds to about 7.5% to about 10.5% of the inner diameter D2 of the sleeve 3. Herein, the inner diameter D2' of the sleeve 13 is the same as the inner diater D2 of the sleeve 3. In case of such a larger dimension, the gap defined between the heater 15 and the sleeve 13 maintains a continuously sufficient size thereof, even if both the heater 15 and the sleeve 13 expand abruptly at an initial operation state of the heater 15, that is, when the heater 15 generates heat suddenly. As a result, the amount of heat by heat conduction carried out from the heater 15 to the cap 12 via the sleeve 13 is reduced, thereby improving overshoot in emission of electrons. In accordance with the present invention, the outer diameter D1' and the height L' of the heater 15 are reduced, thereby providing increased ratio of heating wire turns per length of the heater 15 and increased distance from the holder 14 to the heater 15. The reason for the increased distance between the holder 14 and the heater 15 is to decrease a loss in the amount of heat emitted from the heater 15. On the other hand, the reason for the increased ratio of heating wire turns per length of the heater 15 is to increase the amount of generated heat, so as to compensate for the reduction in heat generated from the heater 15 at its normal operation state, due to the reduction in the diameter of the heater.

Figure 4:
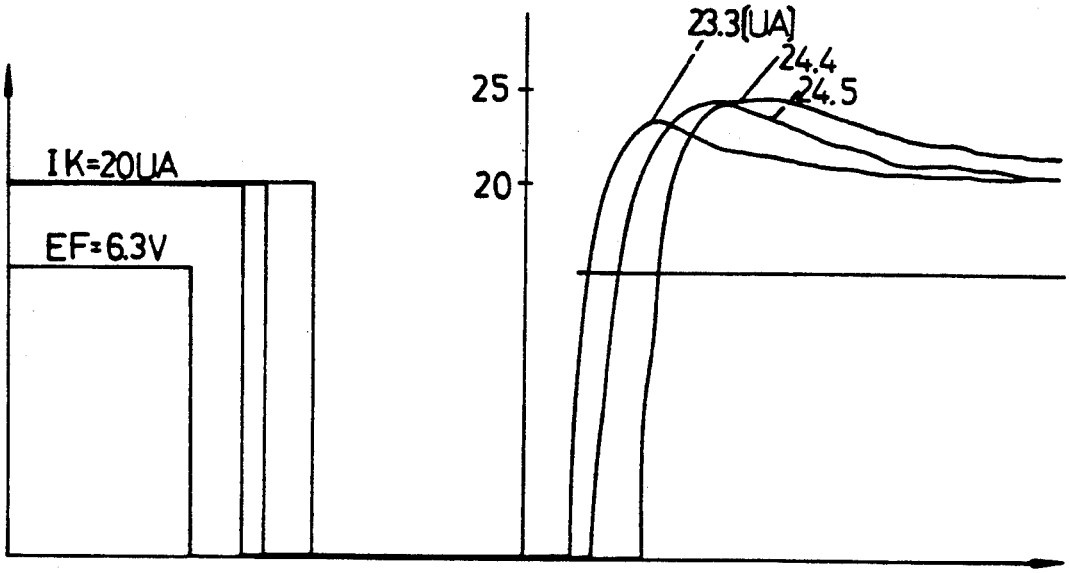
FIG. 4 illustrates an electron-emission characteristic of the cathode structure in FIG. 3.

The cathode structure in FIG. 3, in which both the diameter and the length of the heater 15 are reduced under the condition that the ratio of heating wire turns per length of the heater 15 is still maintained without any change, exhibits an electron-emission characteristic as shown in FIG. 4. Referring to FIG. 4, it can be found that at the initial operation state, that is, when drive voltage of about 6.3 V is applied to heater taps 15*a* and 15*b*, the amount of emitted electrons is abruptly increased so that it corresponds to about 120% of the amount of electrons emitted at the normal operation state, at a maximum. At this time, the rate of increasing the amount of electrons is 5 seconds to 7 seconds. With the cathode structure of the present invention, accordingly, it is possible to maintain the excessive amount of electrons emitted at the initial operation state within an allowable range, that is, about 120% of the amount of electrons emitted at the normal operation state. The rate of increasing the amount of electrons emitted at the initial operation state can be also maintained within 6 seconds to 8 seconds.

As is apparent from the above description, the present invention provides an improved cathode structure wherein a gap defined between a sleeve and a heater is dimensioned such that the ratio of the outer diameter of heater to the inner diameter of sleeve is in a range of 69% to 73%, thereby improving an overshoot in emission of electrons at an initial operation state of heater. In accordance with the present invention, the heater also has increased ratio of heating wire turns per heater length, thereby improving the rate of increasing the amount of emitted electrons. By improving the overshoot in emission of electrons, it is possible to lengthen the life of cathode ray tubes.

What is claimed is:

1. A cathode structure in an electron gun for a cathode ray tube comprising:

a metallic sleeve having a cylindrical shape, said sleeve having an upper portion;

a metallic cap disposed at the upper portion of the sleeve, said cap having an outer top surface;

an electron-emitting material layer coated on the outer top surface of the cap to emit thermal electrons; and a heater disposed in the interior of the sleeve, said heater having an outer surface, such that a predetermined dimension of gap is defined between the inner surface of the sleeve and the outer surface of the heater, to heat the electron emitting material layer by radiant energy applied directly to the cap, said gap having a dimension that is substantially 13.5% to 15.5% of the inner diameter of the sleeve, thereby improving an overshoot in emission of electrons in the initial operation state of the heater.

2. The cathode structure in accordance with claim 1, wherein the electron-emitting material layer is formed from carbonated oxide.

3. A cathode structure in an electron gun for a cathode ray tube comprising:

a metallic sleeve having a cylindrical shape, said sleeve having an upper portion;

a metallic cap disposed at the upper portion of the sleeve, said cap having an outer top surface;

an electron-emitting material layer coated on the outer top surface of the cap to emit thermal electrons;

a heater disposed in the interior of the sleeve, said heater having an outer surface, such that a predetermined dimension of gap is defined between the inner surface of the sleeve and the outer surface of the heater to heat the electron emitting material layer by radiant energy directly applied to the cap, said gap having a dimension that is substantially 13.5% to 15.5% of the inner diameter of the sleeve, thereby improving an overshoot in emission of electrons in the initial operation state of the heater; and said heater being directly exposed to said cap whereby said cap is heated by radiation emitted from said heater.

* * * * *